US006517421B2

(12) United States Patent
Park

(10) Patent No.: US 6,517,421 B2
(45) Date of Patent: Feb. 11, 2003

(54) POLISHING HEAD OF A CHEMICAL AND MECHANICAL POLISHING APPARATUS FOR POLISHING A WAFER

(75) Inventor: Choul-Gue Park, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/803,989

(22) Filed: Mar. 13, 2001

(65) Prior Publication Data

US 2001/0034199 A1 Oct. 25, 2001

(30) Foreign Application Priority Data

Apr. 19, 2000 (KR) ..... 2000-20674

(51) Int. Cl.[7] ..... B24B 29/00

(52) U.S. Cl. ..... 451/287; 251/388; 251/397; 251/402

(58) Field of Search ..... 451/388, 397, 451/398, 402, 287, 288, 289, 290

(56) References Cited

U.S. PATENT DOCUMENTS 5,573,448 A * 11/1996 Nakazima et al. ..... 451/287

6,231,428 B1 * 5/2001 Maloney et al. ..... 451/287

* cited by examiner

*Primary Examiner*—Joseph J. Hail, III
*Assistant Examiner*—Alvin J. Grant
(74) *Attorney, Agent, or Firm*—Volentine Francos, PLLC

(57) ABSTRACT

A polishing head of a chemical and mechanical polishing apparatus can uniformly polishing a wafer by sticking the wafer firmly and with uniform pressure to a polishing pad. The polishing head includes a housing through which air is supplied and discharged from the head. A carrier is connected to the housing so as to be movable up and down relative to the housing. A wafer chucking device is mounted to the carrier. The wafer chucking device includes a wafer chuck body movable up and down relative to the carrier. The wafer chuck body defines a vacuum chamber therein for use in adhering a wafer to the wafer chucking device. A retainer is mounted to the periphery of the carrier, guides the wafer chuck body in its up and down movement relative to the carrier, and protects the wafer chucked by the wafer chucking device. A biasing member is used to exert a downward biasing force uniformly on the wafer chuck body. Because the wafer is held fast against the wafer chuck body, and is pressed in such a state against a polishing pad by the biasing force exerted uniformly on the wafer chuck body independently of the force used to position the retainer against the polishing pad, the wafer is forced against the polishing pad uniformly.

19 Claims, 5 Drawing Sheets

POLISHING HEAD OF A CHEMICAL AND MECHANICAL POLISHING APPARATUS FOR POLISHING A WAFER

BACKGROUND OF THE INVENTION

1. Field of the Invention

The present invention relates to a chemical and mechanical polishing apparatus. More particularly, the present invention relates to the polishing head of a chemical and mechanical polishing apparatus.

2. Description of the Related Art

Manufacturing an integrated circuit on a semiconductor wafer often includes a chemical and mechanical polishing process used to flatten both surfaces of the wafer. The chemical and mechanical polishing process is becoming more important as semiconductor integrated circuits become more highly integrated and the diameter of wafers become larger.

The chemical and mechanical polishing system used in flattening the wafer comprises a detachable device of a wafer cassette, a wafer transferring device, a polishing device, a wafer rinsing device, and a controlling device. The polishing device comprises a polishing pad, a polishing head for supporting and pressing the wafer against the polishing pad, a polishing plate to which the polishing pad is detachably mounted, a driving mechanism for rotating the polishing head relative to the polishing pad, a device for dressing the polishing pad, a mechanism for rinsing the wafer, and a slurry supplying mechanism.

In the mechanical aspect of the polishing process, the polishing head and the polishing pad are rotated relative to one another at a certain speed, and material at the surface of the wafer is removed by the friction produced between the wafer and the polishing pad against which the wafer is pressed to generate a certain pressure. The rate at which material is removed from the wafer is proportional to the polishing pressure and the polishing speed. In the chemical aspect of the polishing process, a chemical reaction at the wafer surface is produced by slurry introduced between the wafer surface and the polishing pad. If the polishing pressure, the polishing speed, the amount of slurry, the friction between the surface of the wafer and the polishing pad, and the polishing temperature are uniform across the entire surface of the wafer, an extensive flattening and uniformity in the thickness of the residual film are achieved. However, in actuality, the above-mentioned factors and conditions at the surface of the wafer change over time. Accordingly, the thickness of the residual film is irregular after being polished. And, the wafer exhibits dishing and thinning phenomena. Therefore, the polishing conditions must be precisely controlled if the wafer is to be flattened satisfactorily.

Various polishing apparatus and methods have been developed in an attempt to achieve a uniform polishing of a wafer. For instance, Japanese Patent Laid-open No. Hei 10-256202 discloses a polishing method and device in which dual fluid pressure chambers produce a uniform polishing. Japanese Patent Laid-open No. Hei 9-246218 discloses a polishing method and device in which an inflatable pad of polyethylene film is used to uniformly polish a wafer. A polishing device which can regulate the pressures of cells is disclosed in U.S. Pat. No. 5,605,488, and a polishing device in which a wafer is uniformly polished by using a flexible plate is disclosed in U.S. Pat. No. 5,851,136. Finally, U.S. Pat. No. 5,803,799 issued to Volodarsky discloses a polishing head for uniformly polishing a semiconductor wafer.

FIG. 1 shows the polishing head of Volodarsky. The polishing head 10 includes a housing 14, a wafer carrier 20 which is mounted to the housing 14 and has a wafer supporting surface 50, and a wafer retainer 22 which is mounted to the housing 14 and maintains the wafer W on the wafer supporting surface 50. Means are also provided for exerting a biasing force on the wafer carrier 20.

During the polishing process, the wafer W is stuck fast to a polishing pad P by the biasing force applied to the wafer carrier 20. The retainer 22 retains the wafer stuck fast to the polishing pad by the wafer carrier 20. Therefore, the wafer is retained in position and is pressed against the polishing pad by the biasing force distributed thereto via the wafer carrier 20, so that the wafer can be uniformly polished. However, in the polishing head of Volodarsky, it is difficult to distribute the biasing force applied to the wafer carrier 20 uniformly over the wafer.

Accordingly, the worked surface of the wafer is not uniformly stuck fast to the polishing pad, and the central and edge portions of the wafer are polished at different rates.

SUMMARY OF THE INVENTION

The present invention has been made in light of the above-mentioned problem of the prior art. Accordingly, it is an object of the present invention to provide a chemical and mechanical polishing apparatus which can uniformly polish a wafer.

In order to achieve the above-mentioned object of the present invention, the present invention provides a polishing head of a chemical and mechanical polishing apparatus for polishing a wafer, which holds a wafer fast against a wafer chuck body of a wafer chucking device, and in such a state exerts a downward uniform pressure on the wafer chuck body to press the wafer uniformly against a polishing pad.

The polishing head includes a housing having air passageways through which air is supplied and/or discharged to and from the polishing head. A carrier is connected to the housing so as to be movable upward and downward relative thereto. The wafer chuck body is, in turn, mounted to the carrier so as to be movable upward and downward relative thereto. A retainer mounted to the periphery of the carrier guides the wafer chuck body in its upward and downward movement relative to the carrier and protects the wafer chucked to the wafer chuck body.

In the present invention, the wafer chuck body and the carrier are independently movable upwardly and downwardly by air pressure. In addition, the wafer chuck body is rotated together with the retainer and the carrier, so that torsion between the carrier and the wafer chuck body is prevented. Therefore, when the wafer chucked by the wafer chuck body is stuck fast to the polishing pad, a surface of the wafer will be polished uniformly.

BRIEF DESCRIPTION OF THE DRAWINGS

The above and other objects, features and advantages of the present invention will become readily apparent by referring to the following detailed description of the preferred embodiment thereof made with reference to the accompanying drawings, of which.

DETAILED DESCRIPTION OF THE PREFERRED EMBODIMENT

Figure 1:
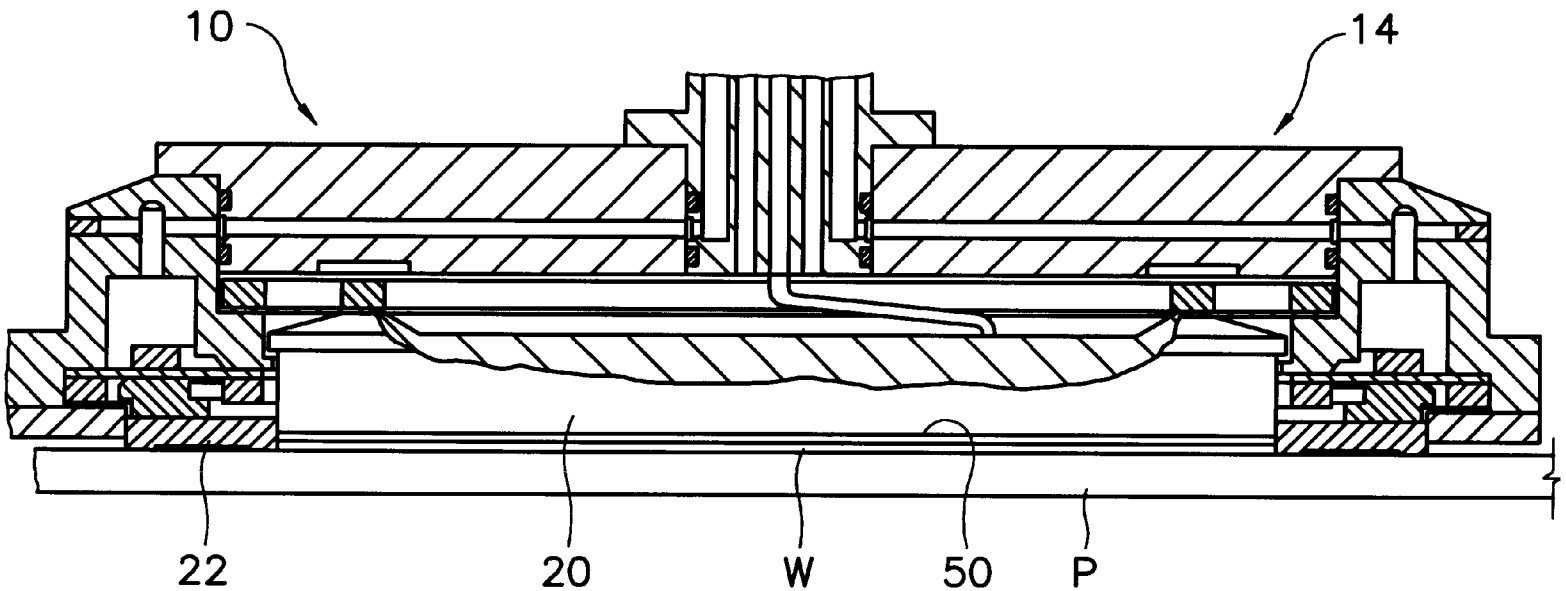
FIG. 1 (PRIOR ART)
FIG. 1 is a cross-sectional view of a polishing head of a conventional chemical and mechanical polishing apparatus.

The preferred embodiment of the present invention will be described in detail hereinafter with reference to the attached drawings.

As shown in FIGS. 2 to 5, a polishing head 100 of the chemical and mechanical polishing apparatus for polishing a wafer according to the present invention includes a housing 110 which defines an air passage system therein, a carrier 120 which is connected to the housing 110 so as to be movable up and down relative thereto, a wafer chucking device 130 which is mounted to the carrier 120, and a retainer 140 fixed to the carrier at the periphery of the carrier 120.

The housing 110 comprises a body portion 112 which has a circular cross section, a flange portion 114 which extends radially outwardly from one end of the body portion 112, and an extending portion 116 which extends downwardly at the center of the body portion 112. The housing 110 is generally made of steel, such as stainless steel.

The air passage system of the housing 110 comprises three passageways, i.e., a first passageway 112*a*, a second passageway 112*b*, and a third passageway 112*c*. The first passageway 112*a* extends through the body portion 112 and the extending portion 116. The second and third passageways 112*b* and 112*c* are disposed symmetrically with respect to the longitudinal axis of the body portion 112.

The extending portion 116 of the housing 110 is received in a central opening 122*a* formed in the carrier 120. The extending portion includes a key (not shown) which extends radially at the outer peripheral portion thereof. The key is received in key-way (also not shown) formed in the inner peripheral surface of the carrier 120 which defines the opening 122*a*. The key-way has the same width and height as the key of the extending portion 116 of the housing 110. Accordingly, the carrier 120 will rotate together with the housing 100 when the polishing head 100 is operated. The chucking device 130 and the retainer 140 which are connected to the carrier 120 will thus rotate together with the housing 110, as well.

The first passageway 112*a* communicates with an air chamber 160 which is defined by and between the carrier 120 and the chucking device 130. The air chamber 160 is inflated or deflated by supplying or discharging air through the first passageway 112*a*. In this way, the chucking device 130 is moved relative to the carrier 120.

The second passageway 112*b* of the housing 110 is radially spaced apart from the first passageway 112*a* by a predetermined distance, and communicates with an air chamber 150 defined by and between the housing 110 and the carrier 120. When air is supplied to the air chamber 150 via the second passageway 112*b*, the carrier 120 is moved downwardly relative to the housing 110. As a result, the retainer 140 engaged with the carrier 120 is also moved downwardly. On the other hand, when air is discharged from the air chamber 150, a vacuum is created in the air chamber 150. Thus, the carrier 120 is moved upwardly to its original position. In this case, the retainer 140 is moved upwardly together with the carrier 120.

The carrier 120 comprises a body portion 122, and a flange portion 124 which extends radially from the lower end of the body portion 122. A first through-hole, forming the opening 122*a*, is formed at the center of the body portion 122 of the carrier 120, and a second through-hole is formed at a position spaced radially outwardly from the first through-hole by a predetermined distance. A plurality of through-holes are formed about the longitudinal axis of the body portion 122 adjacent the outer periphery of the flange portion 124.

An air pipe 112*c* is fixed to the housing 110 within a through-hole to constitute the third passageway extending through the housing 10. The air pipe 112*c* projects downwardly some distance from the lower surface of the housing 110. A second air pipe 122*b* is fixed to carrier 120 within the second through-hole formed in the carrier 120, and receives the projecting end of the air pipe 112*c*. When the air chamber 150 formed between the housing 110 and the carrier 120 is inflated and the carrier 120 is moved downwardly, the air pipe 122*b* of the carrier 120 slides downwardly along the air pipe 112*c* of the housing 110. And, when the air chamber 150 contracts and the carrier 120 is moved upwardly, the air pipe 122*b* of the carrier 120 slides upwardly along the air pipe 112*c* of the housing 110.

The carrier 120 also includes a connector for connecting the carrier 120 to the housing 110. The connector comprises an annular inner clamp 126, an annular outer clamp 128 which has an inner diameter larger than the outer diameter of the inner clamp 126, and an annular resilient sheet 129. One end of the resilient sheet 129 is fixed to the upper surface of the carrier 120 by the inner clamp 126, and the other end of the resilient sheet 129 is fixed to the lower surface of the housing 110 by the outer clamp 128, to thereby connect the carrier 120 to the housing 110.

More specifically, the outer peripheral edge portion of the inner clamp 126 of the connector is recessed to thereby define a step in the outer peripheral edge. The upper outer peripheral portion of the body portion 122 of the carrier also has an annular recess therein. The inner clamp 126 has a first central through-hole which forms part of the central opening 122*a* in the carrier 120, and a plurality of second through-holes which are radially spaced from the first through-hole. The body portion 122 of the carrier 120 has tapped holes in the upper surface thereof aligned with the plurality of through-holes formed in the inner clamp 126. The aligned through-holes receive screws by which the inner clamp 126 is fixed to the body portion 122 of the carrier 120. When the inner clamp 126 is fixed to the upper surface of the carrier 120, the width of the annular recess which is defined between the stepped portions of the inner clamp 126 and the body portion 122 of the carrier 120 is equal to or smaller than the thickness of the resilient sheet 129, so that the resilient sheet 129 is securely fixed to the carrier 120.

The outer clamp 128 has a central body portion, and flange portion 128*a* which extends radially from the upper part of the body portion. The flange portion 128*a* of the outer clamp and the flange portion of the housing 110 have a plurality of corresponding through-holes. The upper end of the inner circumferential portion of the outer clamp 128 is recessed to form a step. The height of the step is smaller than the thickness of the resilient sheet 129. Bolts extending through the through-holes formed in the flange portion 114 of the housing 110 and the flange portion 128*a* of the outer clamp 128 are threaded to nuts to fix the outer clamp 128 to the housing 110 and thereby clamp the outer end of resilient sheet 129 to the housing 110.

The annular resilient sheet 129 is basically an air bladder made of rubber or of a synthetic resin.

The carrier 120 is connected to the housing 110 by the inner and outer clamps 126 and 128 and the resilient sheet 129. After one edge of the resilient sheet 129 is located in the step formed in the upper end of the inner circumferential portion of the outer clamp 128, the housing 110 and the outer clamp 128 are positioned such that through-holes formed in the flange portion 114 of the housing 110 are aligned with through-holes formed in the flange portion 128*a* of the outer clamp 128. Then the bolts are passed through the through-holes formed in the flange portions 114 and 128*a* and are threaded to the nuts.

Then, the inner clamp 126 and the carrier 120 are positioned such that the other end portion of the resilient sheet 129 is located in the annular recess defined by the carrier 120 and the stepped portion of the inner clamp 126. Screws are passed through the through-holes formed in the inner clamp 126, and into the tapped holes 126*b* which are formed in the upper surface of the carrier 120.

The retainer 140 is annular. The inner diameter of the retainer 140 is smaller than the outer diameter of the flange portion 124 of the carrier 120, and the outer diameter of the retainer 140 is larger than that of the flange portion of the carrier 120. The retainer 140 has an annular recess in the upper end portion thereof. The outer diameter of the recess is equal to or larger than the outer diameter of the flange portion 124 of the carrier 120, and the depth of the recess is equal to the thickness of the flange portion 124. Tapped holes, corresponding to the through-holes formed in the flange portion 124 of the carrier 120, extend into the upper end of the retainer 140 at the bottom of the recess. After the flange portion 124 of the carrier 120 is seated in the recess of the retainer 140, and the through-holes formed in the flange portion 124 of the carrier are aligned with the tapped holes formed in the retainer, screws are passed through the through-holes formed in the flange portion 124 of the carrier 120 and into the tapped holes formed in the upper surface of the retainer to connect the carrier 120 to the housing 140.

Furthermore, a plurality of elongate grooves 142 extend axially along the retainer in the inner circumferential surface of the retainer 140. Preferably, four grooves 142 extend along the inner circumferential surface of the retainer 140 as spaced apart from one another by angular intervals of ninety degrees.

The wafer chucking device 130 comprises an inflatable member 132, a wafer chuck body 134 which is attached to the lower surface of the inflatable member 132, a sheet 136 which is attached to the lower surface of the wafer chuck body 134 to prevent the rear surface of the wafer from being damaged, and a fixing means 138 which fixes the inflatable member 132 to the carrier 120.

The inflatable member 132 is annular, and is basically an air bladder made of rubber or of a synthetic resin like the annular resilient sheet 129. The inflatable member 132 has plurality of through-holes disposed radially about the center thereof.

The wafer chuck body 134 comprises an annular first member 134*a*, and a second member 134*b* which is attached to the lower surface of the first member 134, whereby an air chamber 170 is defined between the first and second members 134*a* and 134*b*. A through-hole is formed in the central portion of the first member 134*a*, and an air flow pipe 135 is received in the through-hole. The second member 134*b* comprises a circular body portion which has an outer diameter smaller than that of the first member 134*a*, and an annular wall portion which extends upwardly from the periphery of the body portion to the second member 134. The second member 134*b* is attached to the first member 134*a* by welding or the like such that the first and second members 134*a* and 134*b* are integral. A plurality of through-holes extend through the circular body portion of the second member 134*b*.

The first member 134*a* of the wafer chucking member 134 comprises four protruding portions 134*a*' which protrude outwardly at the periphery thereof as spaced from one another by angular intervals of ninety degrees. The protruding protrusions 134*a*' extend into the elongate grooves 142, respectively, formed in the inner circumferential surface of the retainer 140, such that the chuck body 134 can be moved upwardly or downwardly relative to the carrier 140 as guided by the elongate grooves 142.

The sheet 136 is a circular film of a synthetic resin attached to the second member 134*b*. The sheet 136 has a plurality of through-holes extending therethrough. The through-holes formed in the sheet 136 correspond to and are aligned with the through-holes formed in the second member 134*b* of the chuck body 134.

The fixing means 138 comprises an annular first member 138*a* and a second member 138*b*. The first member 138*a* comprises a tubular body portion, and upper and lower flanges which extend radially outwardly from the lower and upper ends of the tubular body portion, respectively. A plurality of through-holes are formed about the longitudinal axis of the first member 138*a* in the upper flange of the first member 138*a*. After the through-holes formed in the upper flange of the first member 138*a* are aligned with the tapped holes formed in the lower surface of the carrier 120, screws are passed through the through-holes and into tapped holes formed in the bottom of the body portion 122 of the carrier 120. A seal may be disposed between the lower surface of the carrier 120 and the upper surface of the upper flange of the first member 138*a* in order to seal the space 160 defined between the carrier 120 and the chuck body 134. A plurality of through-holes are also formed about the longitudinal axis of the first member 138*a* in the lower flange of the first member 138*a*.

The annular second member 138*b* of the fixing member 138 has through-holes corresponding to the those formed in the lower flange of the first member 138*a*. After the air pipe 135 is fitted to the second member 134*b* of the chuck body 134 within the through-hole formed at the central portion of the first member 134*a*, the inflatable member 132 is bonded to the upper surface of the first member 138*a* of the chucking member 134 with the air pipe 135 passing through the through-hole formed at the center of the inflatable member 132. Then, the outer peripheral portion of the inflatable member 132 is bent upwardly and then inwardly around the lower flange of the first member 138*a* of the fixing means 138 until the through-holes formed in the outer peripheral portion of the inflatable member 132 are aligned with the through-holes formed in the lower flange of the first member 138*a*. Then, the second member 138*b* of the fixing member 138 is positioned on the outer peripheral portion of the inflating member 132 with the through-holes formed in the second member 138*a* of the fixing member 138 aligned with the through-holes formed in the lower flange of the first member 138*a* of the fixing member 138 and the through-holes formed at the outer peripheral portion of the inflatable member 132.

Before the fixing member 138 is connected to the chuck body 134, the air flow pipe 135 mounted to the first member 134*a* of the wafer chucking member 134 and the air pipe 122*b* extending through the carrier 120 are connected by a supplying and discharging pipe 122 so that air can be supplied to and discharged from the air chamber 170 defined by the first and second members 134*a* and 134*b*.

Finally, fasteners are passed through the through-holes formed in the second member 138*b* of the fixing member 138, the through-holes formed in the outer peripheral portion of the inflatable member 132 and into the holes formed in the lower flange of the first member 138*a*, such that the air chamber 160 defined by the inflatable member 132, the first member 138*a* of the fixing member 138, and the carrier 120 is sealed.

The operation of the polishing head according to the present invention will now be described with reference to the drawings.

Figure 2:
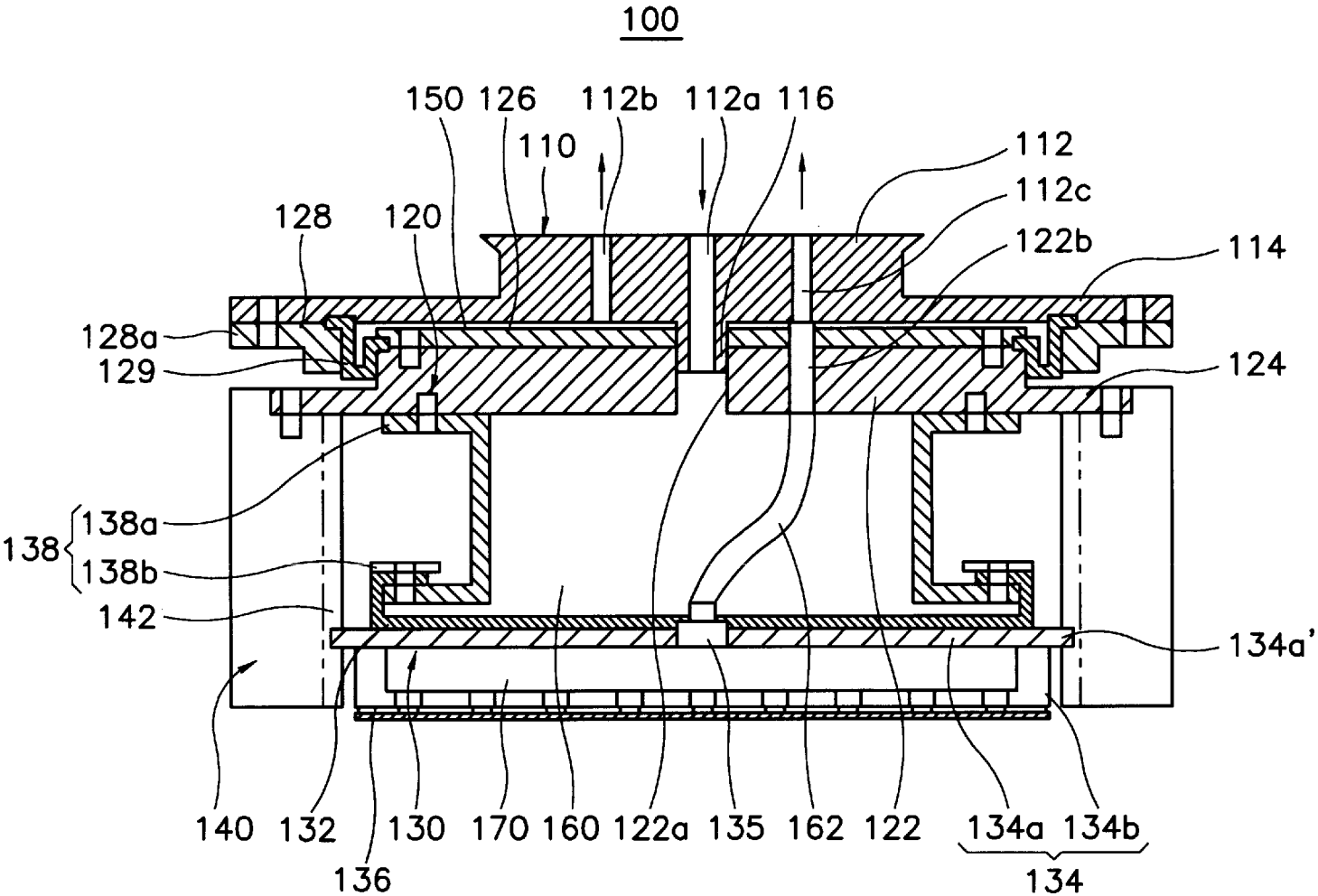
FIG. 2 is a cross-sectional view of a polishing head of a chemical and mechanical polishing apparatus according to the present invention, and shows a carrier of the apparatus in an upper position at which a wafer is chucked to the polishing head.

First, as shown in FIG. 2, the air is discharged from the air chamber 150 via the second passageway 112*b* of the housing 110 to create a vacuum in the air chamber 150. Once the air chamber 150 is sufficiently evacuated, the carrier 120 is held fast to the lower surface of the housing 110 by the negative pressure of the vacuum.

With the carrier 120 held tightly to the lower surface of the housing 110, the retainer 140 connected to the carrier 120 and the wafer chucking device 130 are located in an upward position. Then, air is supplied to the air chamber 160 through the first passageway 112*a* of the housing 110 to inflate the inflatable member 132, thereby causing the chucking member 134 to move downwardly until the sheet 136 is positioned on the same plane as the bottom surface of the retainer 140.

Once the chucking member 134 is moved to this position, air is discharged from the air chamber 170. Thus, a wafer W which is fed by a wafer feeding device (not shown) is drawn to the sheet 136 attached to the chuck body 134.

Once the wafer W adheres to the sheet 136 and covers the through-holes extending therethrough, the discharging of air from the chamber 170 creates a vacuum in the chamber 170 which causes the wafer W to adhere more strongly to the sheet 136.

Figure 3:
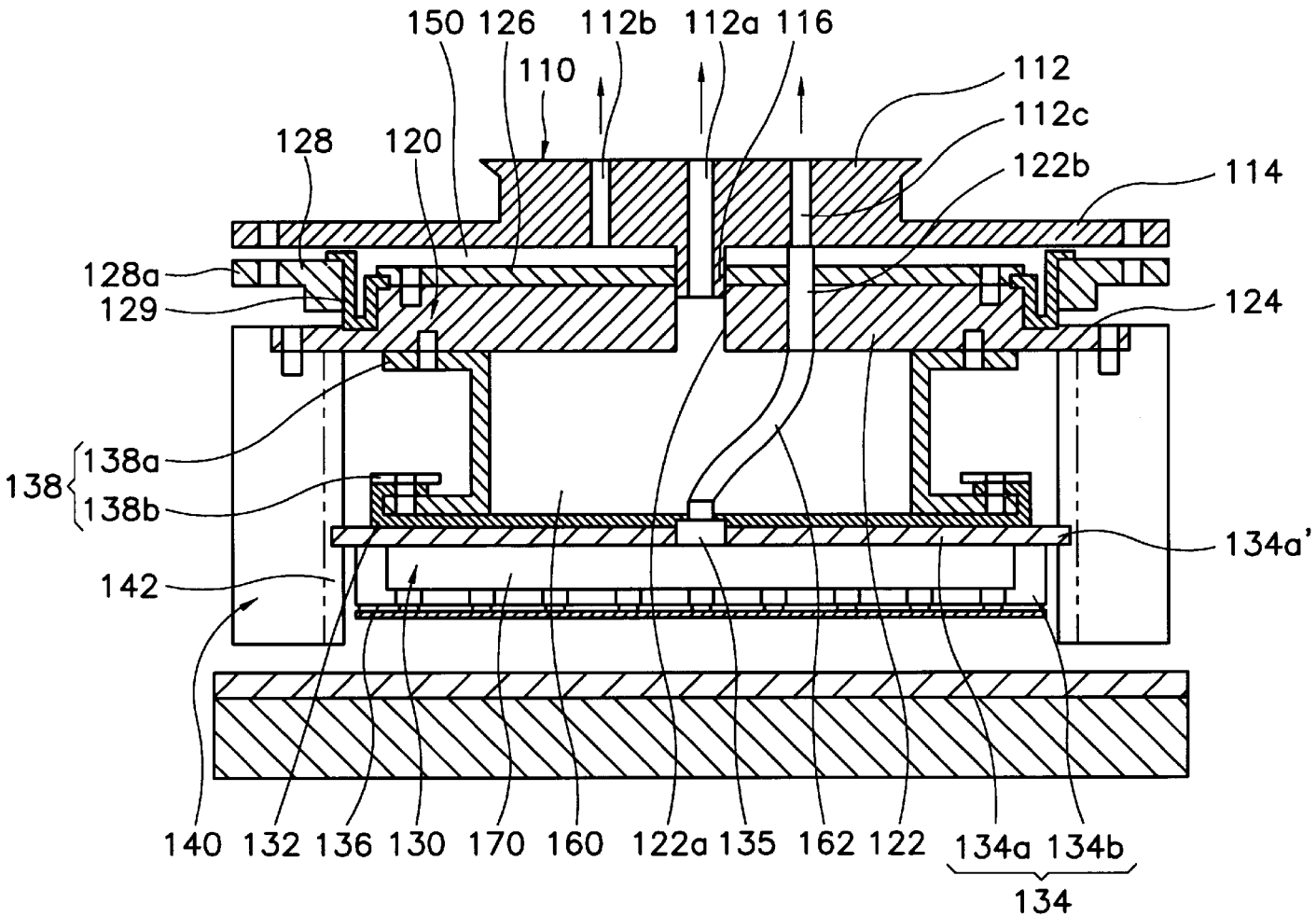
FIG. 3 is another cross-sectional view of the polishing head of a chemical and mechanical polishing apparatus according to the present invention, but shows a wafer being moved onto a polishing pad of the apparatus.

Referring now to FIG. 3, air is now discharged from the air chamber 160 via the passageway 112*a* extending through the body portion 112 and extension member 116 of the housing 110. Thus, the air chambers 150, 160, and 170 are all evacuated. Therefore, the inflatable member 132 of the chucking device 130 is collapsed upward towards the fixing member 138. Consequently, the chuck body 130 is raised and the chucked wafer W is brought above the lower surface of the retainer 140.

Figure 4:
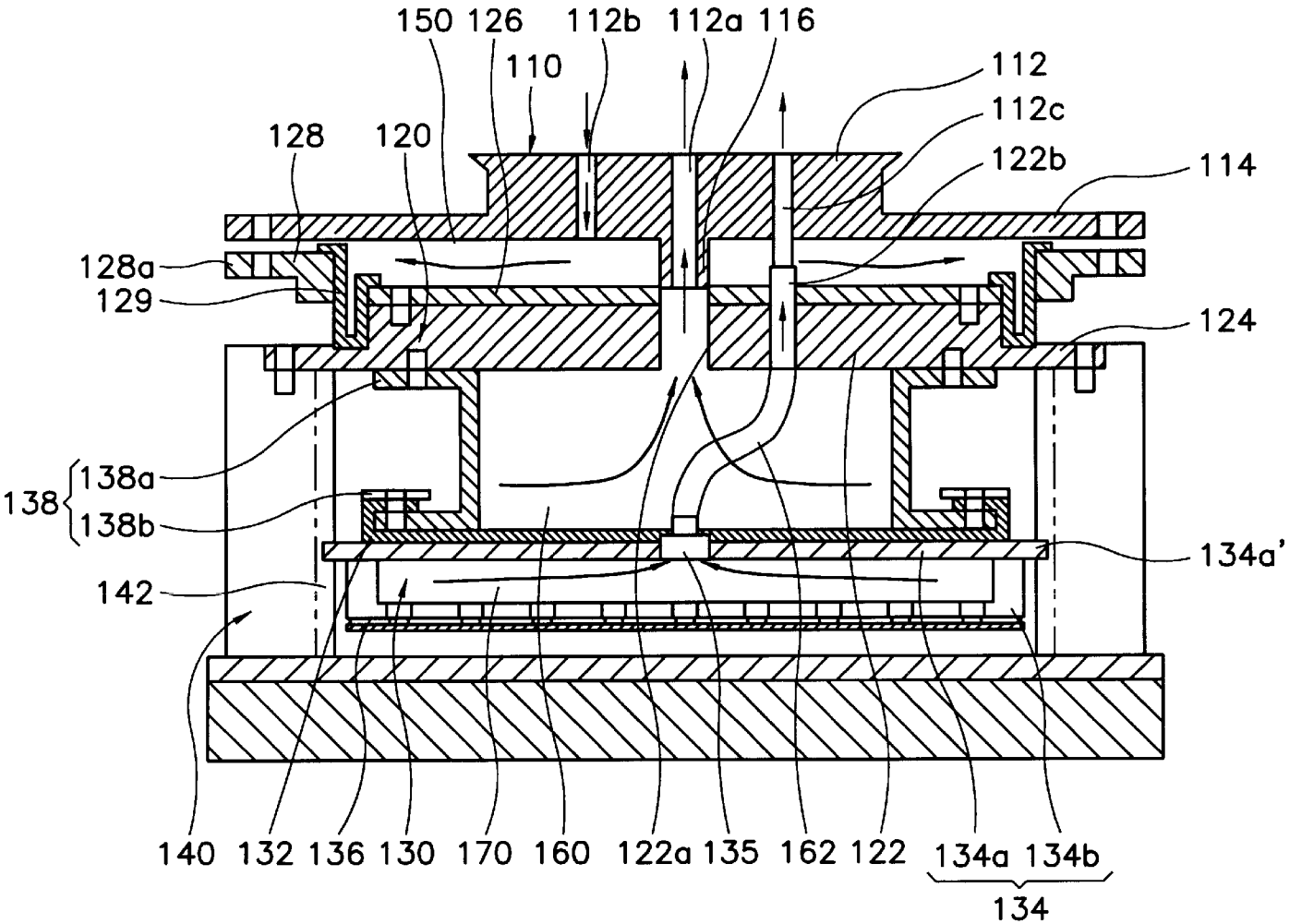
FIG. 4 is still another cross-sectional view of the polishing head of a chemical and mechanical polishing apparatus according to the present invention, but shows the carrier moved to a downward position such that a retainer of the polishing head is placed in contact with the surface of the polishing pad.

Then, as shown in FIG. 4, while the air chamber 160 formed between the carrier 120 and the chucking device 130 and the air chamber 170 formed between the first member 134*a* and the second member 134*b* of the chuck body 134 remain evacuated, air is supplied to the air chamber 150 formed between the housing 110 and the carrier 120. As a result, the carrier 120 is moved downwardly. Furthermore, the retainer 140 and the chucking device 130 connected to the carrier 120 are moved downwardly together with the carrier 120. Thus, the retainer 140 is brought into contact with the upper surface of the polishing pad. However, since the chucking device 130 is located above the lower surface of the retainer 140, the wafer W remains off of the upper surface of the polishing pad.

Figure 5:
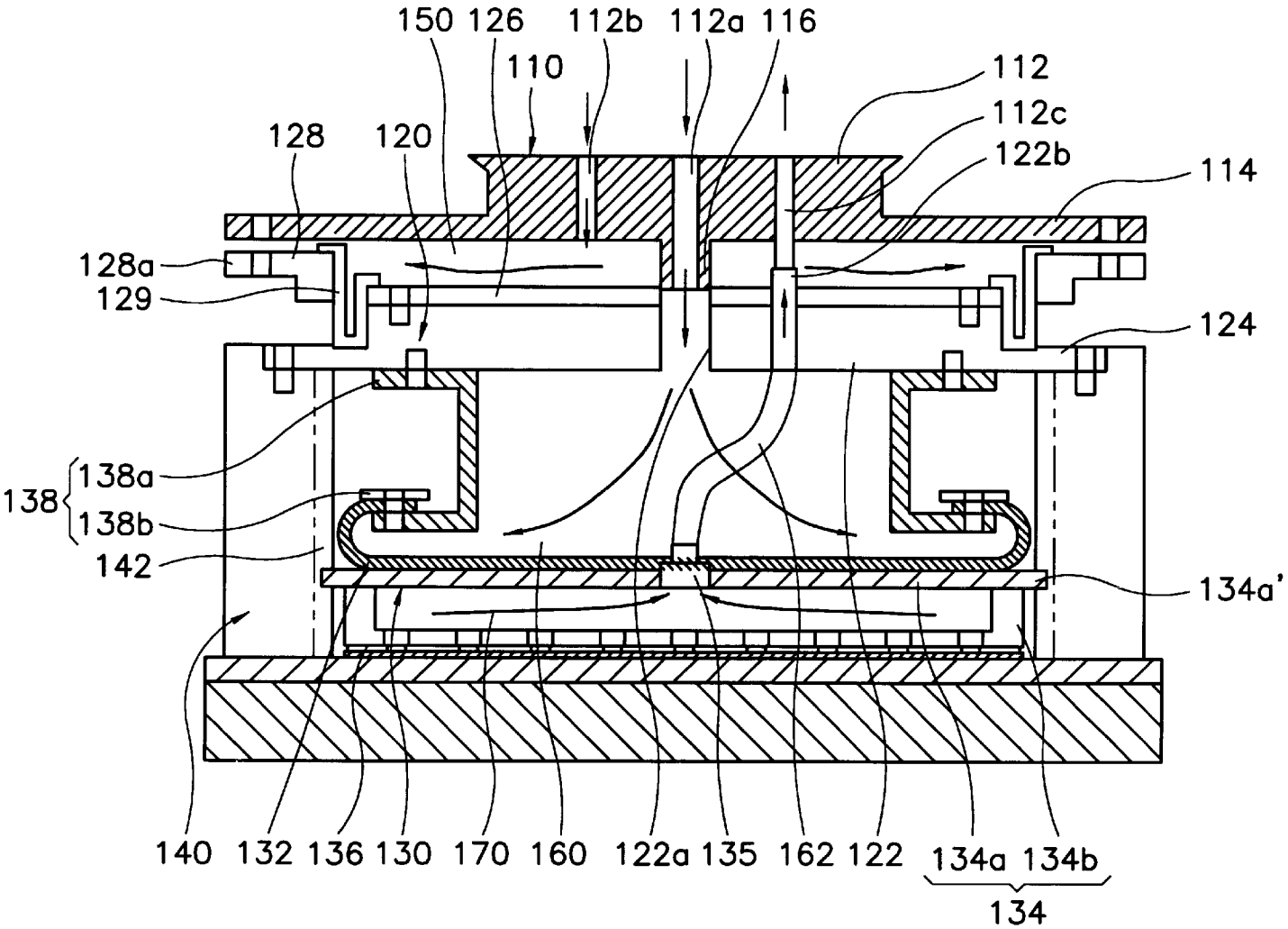
FIG. 5 is still another cross-sectional view of the polishing head of a chemical and mechanical polishing apparatus according to the present invention, but shows a wafer in contact with the surface of the polishing pad.

Then, as shown in FIG. 5, while air continues to be supplied into the air chamber 150, and air continues to be discharged from air chamber 170, air is supplied into the air chamber 160 formed between the carrier 120 and the inflatable member 132 of the chucking device 130 to increase the pressure in the air chamber 160. As the pressure in the air chamber 160 is increased, the inflatable member 132 is inflated and the chucking device 130 connected to the inflatable member 132 is moved downwardly. As a result, a surface of the chucked wafer W is brought into contact with the upper surface of the polishing pad. The wafer W is stuck fast to the polishing pad by continuously increasing the pressure in the air chamber 160 formed between the carrier 120 and the chucking device 130.

Once the wafer W is stuck fast to the polishing pad, a slurry is supplied between the wafer W and the polishing pad, and the polishing head and the polishing pad are rotated relative to one another, whereby the wafer W is polished.

According to the present invention, the entire surface of the wafer is forced uniformly against the polishing pad because of the pressure applied against the chuck body, by an inflated resilient member, independently of the force used to press the retainer against the polishing pad. Thus, the wafer contacts the polishing pad uniformly. Therefore, the entire surface of the wafer from the central portion to the peripheral edge thereof is uniformly polished.

Although the present invention has been described in detail with respect to the preferred embodiment thereof, it is to be understood that the present invention is not limited to the preferred embodiment but that various changes and modifications can be made thereto by one skilled in the art without departing from the true spirit and scope of the present invention as defined by the appended claims.

What is claimed is:

1. A polishing head of a chemical and mechanical polishing apparatus for polishing a wafer, comprising:

a housing;

a carrier mounted to said housing so as to be movable up and down relative to said housing;

a wafer chucking device including a wafer chuck body disposed beneath said carrier and mounted to said carrier so as to be movable up and down relative thereto independently of the up and down movement of said carrier relative to said housing, a wafer chucking surface dedicated to support a wafer during the polishing thereof, and biasing means for forcing said chuck body downwardly away from said carrier by exerting a downward biasing force uniformly across said chuck body; and a retainer fixed to said carrier so as to move up and down therewith, said retainer extending downwardly from said carrier and around said wafer chuck body so as to protect a wafer held against said wafer chucking surface, and said retainer being in sliding engagement with said wafer chuck body for guiding the wafer chuck body up and down relative to said carrier.

2. The polishing head of a chemical and mechanical polishing apparatus according to claim 1, wherein said housing comprises a body portion, and an extending portion extending downwardly from said body portion, said carrier having an opening into which said extending portion of the housing extends, said extending portion guiding said carrier in its up and downward movement relative to said housing.

3. The polishing head of a chemical and mechanical polishing apparatus according to claim 2, wherein a first inflatable air chamber is defined between said housing and said carrier, a second inflatable air chamber is defined between said carrier and said wafer chuck body, said opening in the carrier is a through-hole that extends through said carrier and communicates with said second inflatable air chamber, and said housing has first and second air passageways extending therethrough, said first air passageway extending through the body portion and the extending portion of said housing so as to communicate with said second inflatable air chamber, said second passageway communicating with said first inflatable air chamber.

4. The polishing head of a chemical and mechanical polishing apparatus according to claim 3, wherein said chuck body defines an air chamber therein communicating with said wafer chucking surface, and said housing has a third air passageway communicating with the air chamber in said chuck body.

5. The polishing head of a chemical and mechanical polishing apparatus according to claim 3, wherein said chuck body defines an air chamber therein communicating with said wafer chucking surface, said housing has a third air passageway communicating with the air chamber of said chuck body, and said carrier has an air passageway extending therethrough, the air passageway extending through said carrier placing said third air passageway extending through said housing in communication with the air chamber in said chuck body.

6. The polishing head of a chemical and mechanical polishing apparatus according to claim 5, wherein said third air passageway extending through said housing is a first air pipe, and said air passageway extending through said carrier is a second air pipe, said first and second air pipes having respective ends fitted to and slidable relative to one another.

7. The polishing head of a chemical and mechanical polishing apparatus according to claim 2, wherein an inflatable air chamber is defined between said housing and said carrier.

8. The polishing head of a chemical and mechanical polishing apparatus according to claim 7, wherein said housing has an air passageway extending therethrough in communication with said inflatable air chamber, whereby the carrier is moved downwardly by the pressure of air supplied into the air chamber through the air passageway in the housing, and is moved upwardly-by negative pressure in the air chamber when air in the air chamber is discharged therefrom through said passageway.

9. The polishing head of a chemical and mechanical polishing apparatus according to claim 8, and further comprising a resilient member connecting said carrier to said housing and defining the inflatable air chamber therewith.

10. The polishing head of a chemical and mechanical polishing apparatus according to claim 9, wherein said resilient member is tubular so as to have first and second ends, and further comprising an inner clamp clamping one of the ends of said resilient member to said carrier, and an outer clamp clamping the other end of said resilient member to said housing.

11. The polishing head of a chemical and mechanical polishing apparatus according to claim 1, wherein said retainer is an annular member extending axially downwardly from said carrier.

12. The polishing head of a chemical and mechanical polishing apparatus according to claim 11, wherein said retainer has a plurality of elongate grooves extending axially therealong in an inner circumferential surface thereof, and said wafer chuck body has a plurality of protrusions extending into said grooves, respectively, in sliding engagement with said retainer.

13. The polishing head of a chemical and mechanical polishing apparatus according to claim 11, wherein said carrier has a radially outwardly extending flange at a lower portion thereof, and said retainer has a recess in an upper end thereof open to said inner circumferential surface so as to define a step in the upper end, said recess having a depth equal to the thickness of said flange, and said flange being seated in said recess.

14. The polishing head of a chemical and mechanical polishing apparatus according to claim 1, wherein said biasing means of the wafer chucking device comprises a resilient member fixed to said wafer chuck body at the top of the wafer chuck body, and said resilient member being connected to said carrier.

15. The polishing head of a chemical and mechanical polishing apparatus according to claim 14, wherein said resilient member is an expandable air bladder made of rubber or a synthetic resin, said air bladder forming an inflatable air chamber with and between said carrier and said wafer chuck body.

16. The polishing head of a chemical and mechanical polishing apparatus according to claim 14, wherein the wafer chuck body comprises an upper first member, and a lower second member attached to the first member and defining an air chamber therebetween, said first member having an air passageway extending therethrough at a central portion thereof in communication with said air chamber, and said second member having a plurality of through-holes extending therethrough in communication with said air chamber.

17. The polishing head of a chemical and mechanical polishing apparatus according to claim 16, wherein said wafer chucking device further comprises a film of a synthetic resin attached to the bottom of said second member, said film having a plurality of through-holes aligned with the through-holes in the second member, the bottom of said film constituting said wafer chucking surface.

18. The polishing head of a chemical and mechanical polishing apparatus according to claim 16, wherein said retainer has a plurality of elongate grooves extending vertically in an inner circumferential surface thereof, and said second member of the chuck body has a plurality of protrusions extending into said grooves, respectively, in sliding engagement with said retainer.

19. The polishing head of a chemical and mechanical polishing apparatus according to claim 16, and further comprising an air supplying and discharging pipe connected to said air passageway for supplying and discharging air into and from the air chamber defined by the first and second members of said chuck body.

* * * * *